US007753344B1

(12) United States Patent
Moretz et al.

(10) Patent No.: US 7,753,344 B1
(45) Date of Patent: Jul. 13, 2010

(54) PRESSURIZED WIRE LINE SPOOL AND METHOD FOR USING SAME IN CONJUNCTION WITH A UNIVERSAL RADIAL CARRIER

(76) Inventors: Benny W. Moretz, 301 Cutlass Loop, Rayne, LA (US) 70578; Robert N. Montgomery, 109 Brownlee Ave., Broussard, LA (US) 70518

( * ) Notice: Subject to any disclaimer, the term of this patent is extended or adjusted under 35 U.S.C. 154(b) by 252 days.

(21) Appl. No.: 11/986,090

(22) Filed: Nov. 19, 2007

(51) Int. Cl.
*B66D 1/00* (2006.01)

(52) U.S. Cl. ..... 254/331; 254/329; 254/332; 254/385

(58) Field of Classification Search ..... 254/288, 254/329, 331, 332, 285
See application file for complete search history.

(56) References Cited

U.S. PATENT DOCUMENTS 2,810,439 A 10/1957 McCullough et al.
3,415,317 A 12/1968 Drivet
3,656,715 A * 4/1972 Powell ..... 254/331
3,791,627 A * 2/1974 Stone et al. ..... 254/331
4,428,421 A 1/1984 Rankin
4,577,693 A 3/1986 Graser
5,457,988 A * 10/1995 Delatorre ..... 73/152.51
5,611,522 A * 3/1997 Zaguroli, Jr. ..... 254/331
5,893,417 A * 4/1999 Pizzolato ..... 166/377
6,443,431 B1 * 9/2002 Stasny et al. ..... 254/385
6,520,485 B1 * 2/2003 Soot ..... 254/331

* cited by examiner

*Primary Examiner*—Emmanuel M Marcelo
(74) *Attorney, Agent, or Firm*—Robert N. Montgomery

(57) ABSTRACT

A well head attachment is provided having an elongated casing or housing structure in which the tool string, including the entire cable or wire line supply, is pressurized, the housing structure being arranged to place the interior thereof in communication with the well bore in a manner whereby well pressure is equalized throughout the assembly during all operations, utilizing a unique pressure-tight adjustably articulated riser assembly with off-set pivotal radial connections for connection between the wellhead attachment and the pressurized cable-supply reel, thus the need for lengthy sinker weights, lubricators and stuffing boxes is reduced or eliminated.

25 Claims, 13 Drawing Sheets

PRESSURIZED WIRE LINE SPOOL AND METHOD FOR USING SAME IN CONJUNCTION WITH A UNIVERSAL RADIAL CARRIER

1. FIELD OF THE INVENTION

This invention relates generally to wire line winch apparatus and more particularly to wire line winches in oil and gas communication with well bores under pressure by way of pressurized radial wire line conveyors for pivotally conveying wire lines from the winch assembly to the well bore in complex configurations.

2. GENERAL BACKGROUND

Wire line operations generally relate to the attachment of tubular members to a wellhead through which flexible cables called slick lines and wire lines (electrical conductor cables) and tools connected and/or supported thereby are inserted into the well bore while the well is under pressure.

As those in the art are aware, during operation of an oil or gas well, it often becomes necessary to introduce various tools and instruments into the well bore and operate same within the down hole tubing environment while the well is under pressure. These tools and instruments are ordinarily inserted into the well by using flexible cable or wire lines which may also be insulated electrical conductors that carry electrical power to such down hole instruments and tools. Since very high pressures may exist within the well, the introduction of such tools and instruments is considerably more difficult and there is always the possibility of blowouts or other serious accidents.

In order to conduct the various wire line operations, tools and instruments are introduced into the production string by lowering the tools into the well on flexible cable or wire lines. In the case of electrically operated or actuated tools and instruments, the lowering line or cable often includes electrical conducting wires encased in suitable insulation and armor.

Due to the forces exerted by high well pressures against the tools and cables entering the well, conventional practices use various methods to overcome these forces in order to allow the tools to descend into the well. Such methods generally included adding heavy weights or so-called "sinker bars" having sufficient weight to overcome the opposing pressure forces of the instrument or tool being inserted into the well bore.

A typical wire line setup employs a tubing string or riser attachment adapted for connection to the wellhead above the shut-off valves, the tubing string having size and length to accommodate the tool or instrument length and sufficient sinker bars to overcome the well's pressure. Therefore, in many cases the riser tubing may become quite lengthy. In such cases, the upper end of the riser tubing must be supported by using the derrick elevator cable. A radial housing having a pulley therein is attached to the upper end of the riser, to which is also attached a second vertical tubing string to direct the wire line 180 degrees in a downward direction parallel to the riser tube. The wire line, paid off from a winch spool, is then threaded through the second vertical tubing string, around the radial pulley, out the end of the riser tubing string and connected to the tool or instrument. The instrument or tool is then retracted within the riser via the wire line and the riser assembly is then lifted by the elevator cable attached to the radial pulley housing and attached to the wellhead. In some cases the radial pulley is also electrically or hydraulically powered. In any case, it should be noted that this procedure must be repeated in reverse to retrieve the instrument or tool and must also be repeated with each successive deployment of such tools or instruments. The length and/or size of the riser assembly must be changed to accommodate each new tool or instrument by adding or subtracting riser joints and sinker bars.

Because of the high pressures which may be encountered in the well, instruments and tools and their suspension cable, in accordance with conventional practices, are fed into the well through lubricators, attached to the second vertical riser tubing, which commonly use heavy grease stuffing boxes designed to squeeze tightly about the lowering line or electrical cable in order to prevent escape of the well pressure and to hold the well under control.

These conventional systems have a difficult time in preventing leakage around the conductor cable or wire line. Obviously, the greater the well pressure, the tighter compression around the wire line must be. However, any such additional pressure results in additional friction on the wire line or cable, thus preventing the tool string from freely descending into the well bore. Higher compression applied to the wire line will also often result in serious damage to the slick line or to the wire line electrical conductors. Thus, stuffing box arrangements are actually self-defeating.

Although various apparatus have been disclosed by the prior art in which wellhead attachments are disclosed that teach the use of elongated closed casing or housing structures in which the tool string, including the entire cable or wire line supply, is enclosed in a manner whereby the housing structure is subjected to the well bore pressure, such apparatus have not gained wide spread acceptance in the art due to several disadvantages. The wellhead riser attachment and pressurized wire line spool assemblies only allows the riser assembly to be configured in a single plane and do not provide for offsets and multiple radial bends between the well head and the cable spool assembly.

Further, the prior art pressurized wire line spool assemblies fail to provide a satisfactory method for making a rotary electrical connection between the potentially explosive atmosphere of the wire line spool and the electrical supply leading to the down hole instruments. In addition, no provisions are made in the prior art pressurized wire line spool assemblies for easily adding or changing the wire or cable within a fully enclosed spool without extensive disassembly of the pressurized spool housing.

When it is considered that often tools and instruments must be lowered many thousands of feet into and withdrawn from a well, it will be obvious that the difficulty of running tools rapidly, efficiently, and safely under high pressures will be greatly intensified.

Still further, translating the spool within a pressurized spool housing while rotating the spool under pressure is very difficult in practice, as is maintaining pressure integrity under such high pressures with multiple housing penetrations as required by the prior art.

Accordingly, it is a primary object of the present invention to provide a wire line riser attachment for wellheads by which the various difficulties heretofore encountered in inserting and operating flexible cable-supported tool strings in high pressure wells will be obviated or eliminated.

A further object is to provide a wellhead attachment which includes a pressure-tight housing enclosing a cable-supply reel, cable measuring devices, and tools to be inserted into the well under well pressures, and means for driving the cable-supply reel from the exterior of the housing.

Another object of the invention is to provide a pressure-tight riser assembly having off-set pivotal radial connections for connection between the wellhead and the pressurized cable-supply reel.

3. SUMMARY OF THE INVENTION

In accordance with the present invention, a well head attachment is provided which comprises an elongated closed casing or housing structure in which the tool string, including the entire cable or wire line supply, is enclosed, the housing structure being arranged to place the interior thereof in open communication with the well.

Enclosing the cable supply as well as the tool string within a closed housing, the interior of which is in open communication with the well, the well pressure is equalized throughout the housing and all other operations, including lowering and raising of the tool strings and manipulation thereof in the well by means of the flexible cable. Therefore, wire line operations may be conducted without the hazards and disadvantages of more conventional systems. In addition, the need for lubricators and stuffing boxes is eliminated. The need for lengthy sinker weights is also substantially reduced.

The disclosed pressurized wire line cable supply apparatus may be located remote from the well head and provides a significantly reduced explosive environment within the pressurized cable housing, while allowing easy access to the wire line spool assembly when necessary for inspection and wire replacement.

A unique pressure-tight adjustable articulated riser assembly with off-set pivotal radial connections for connection between the wellhead attachment and the pressurized cable-supply reel is also provided.

4. BRIEF DESCRIPTION OF THF DRAWINGS

For a further understanding of the nature and objects of the present invention, reference should be made to the following detailed description taken in conjunction with the accompanying drawings, in which, like parts are given like reference numerals, and wherein.

5. DETAILED DESCRIPTION OF THE PREFERRED EMBODIMENT

Figure 1:
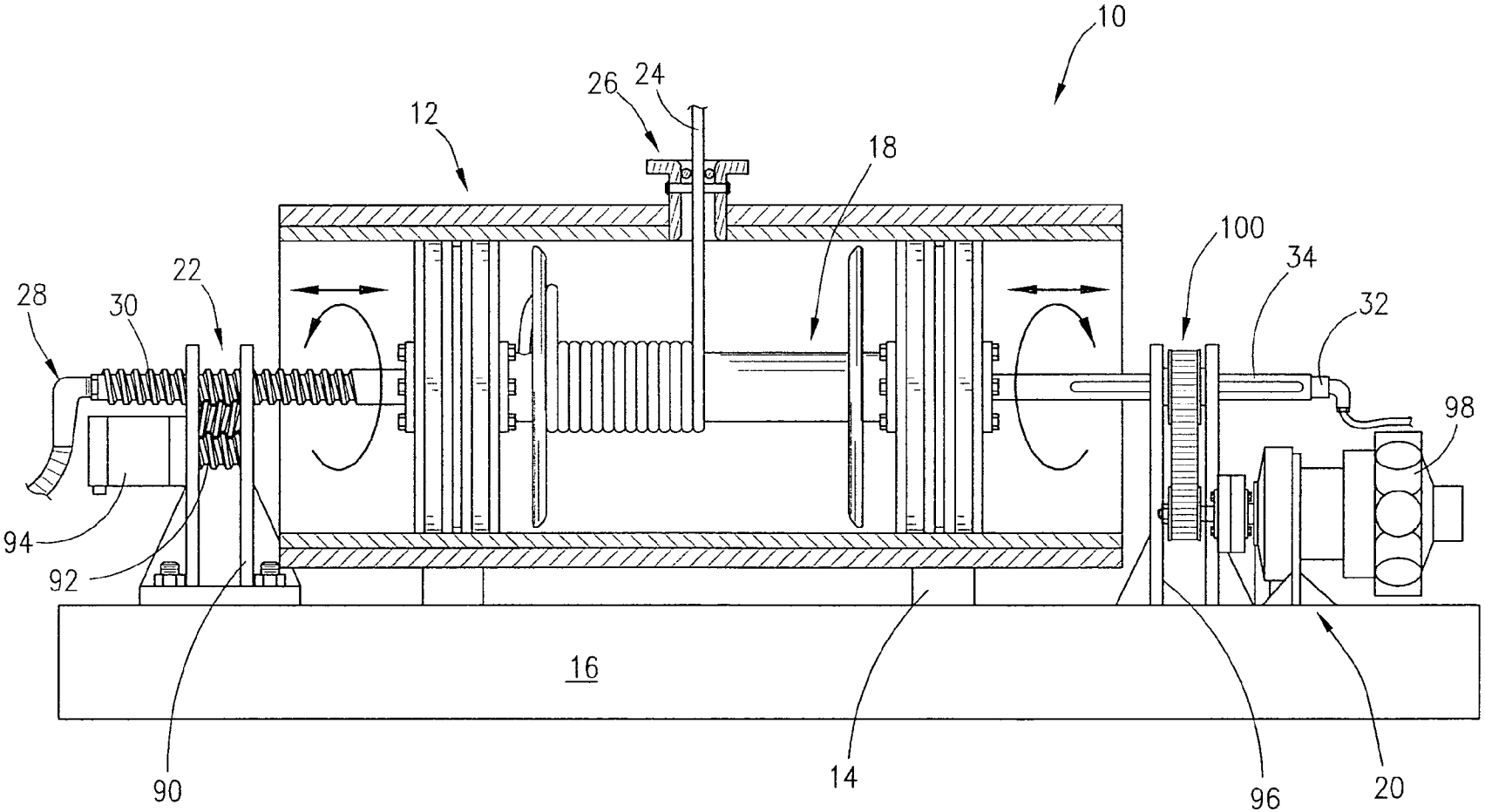
FIG. 1 is a partial vertical cross section view of the wire-line reel assembly.

As first seen in FIG. 1, a pressurable wire line winch assembly 10 is provided that includes an elongated tubular housing assembly 12 rotatably supported upon saddles 14 attached to a base frame structure 16. A spool assembly 18 is rotatably driven by a rotating drive assembly 20 and is translatable within the tubular housing assembly 12 by a translating drive assembly 22.

A cable or flexible wire 24 is fed into and out of the winch assembly 10 through an enclosed connecting flange collar assembly 26, to be connected to an articulated cable conveyor or carrier to be discussed later herein. An electrical slip ring/input swivel assembly 28, is connected to an electrical supply source and is provided at one end of the translation drive shaft 30 having external threads thereon and a lubrication swivel assembly 32 is connected to a lubrication supply source and is provided at the opposite end of the winch assembly 10 through the keyed rotary drive shaft 34.

Figure 2:
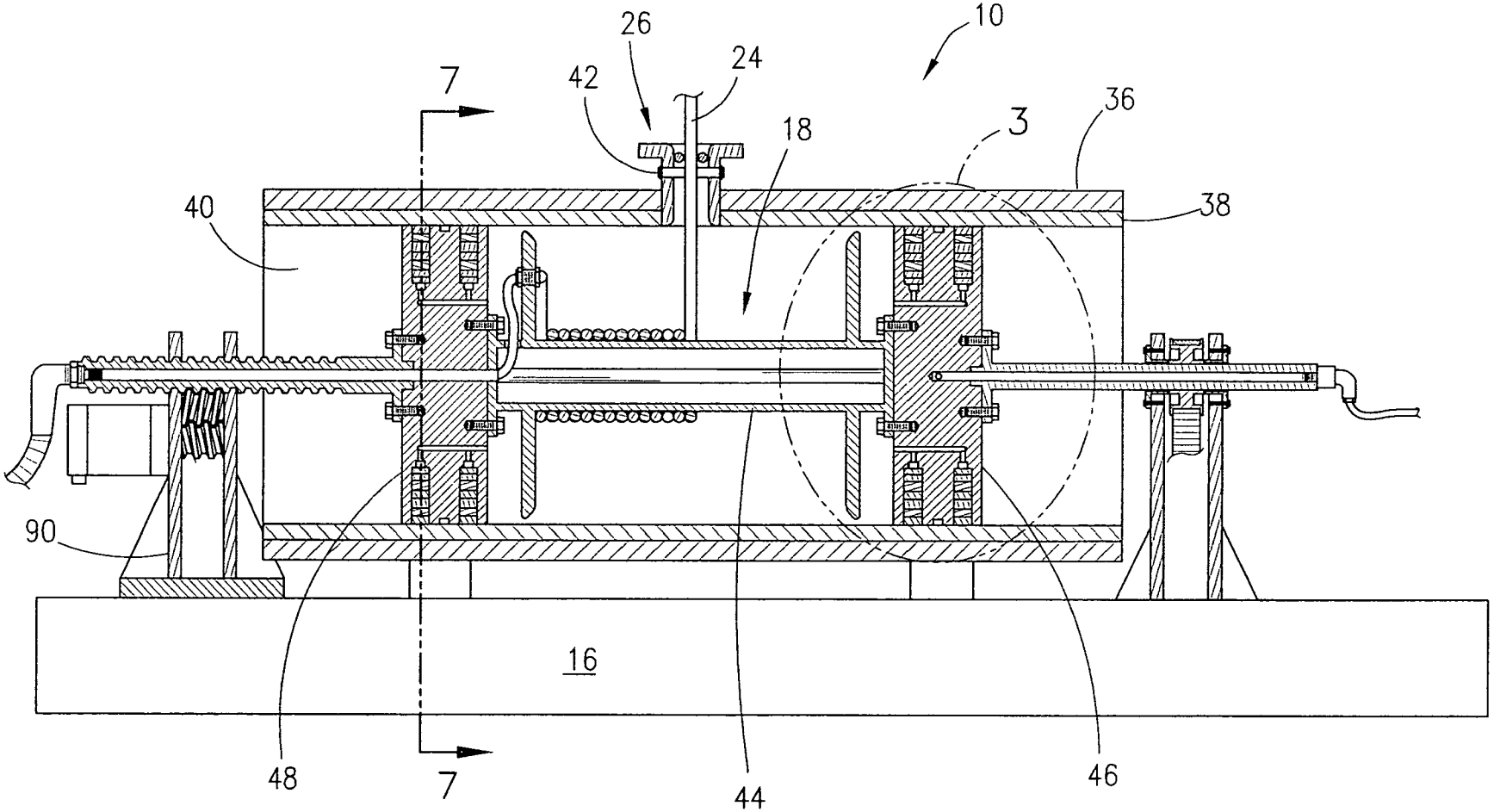
FIG. 2 is a vertical cross section view of the wire line reel assembly taken along the central rotating axis.

The tubular housing assembly 12 as shown in FIG. 2, is open at each end and includes an elongated casing 36 that is true bored and fitted with an internal casing liner 38 having a honed and polished hard chrome inner surface 40. A tubular member and flange collar assembly 26, located perpendicular to the casing 36 midway there along, penetrates both the casing 36 and the liner 38 and further provides entry way guide rollers 42 therein for the wire line or cable 24.

Figure 3:
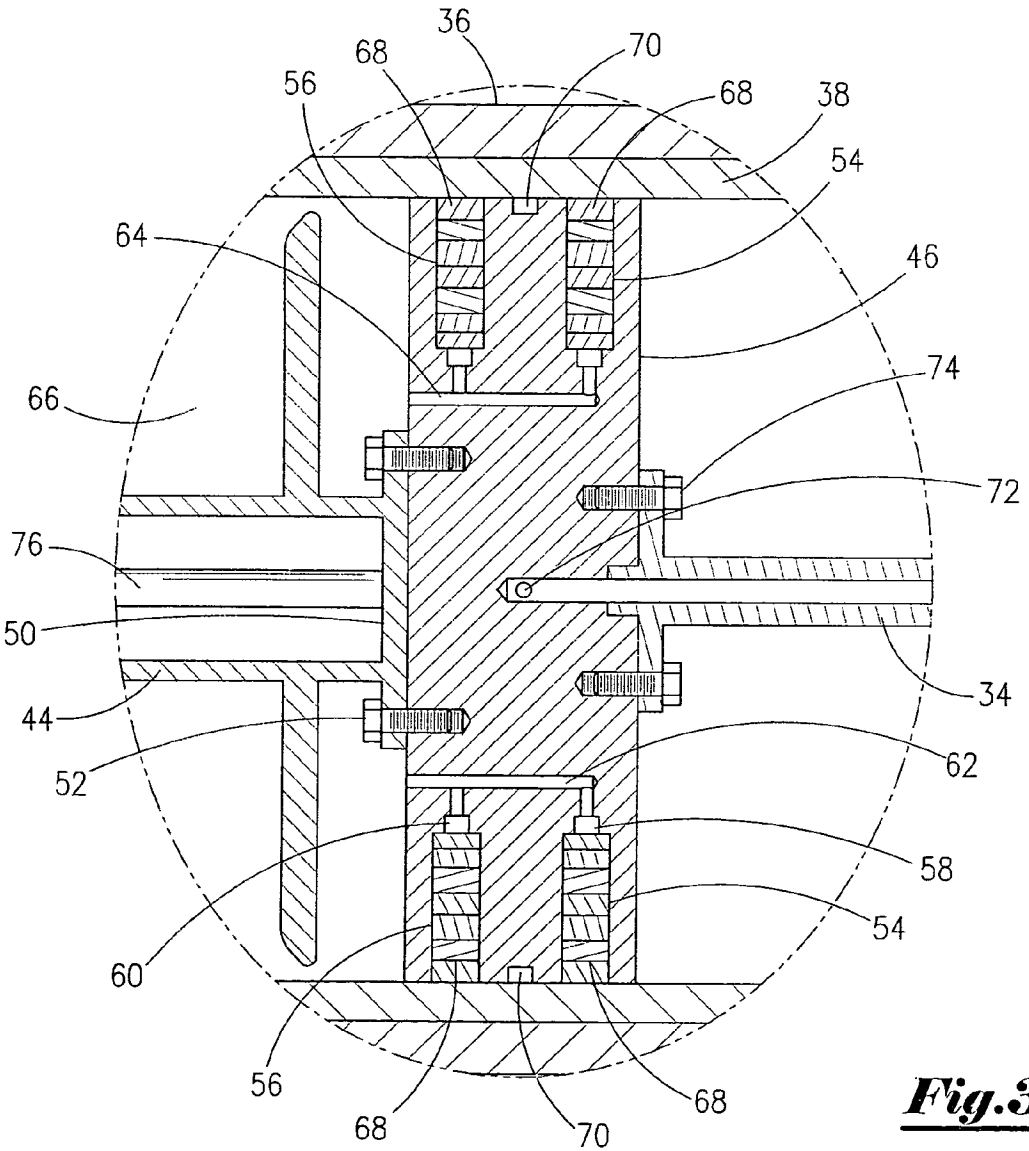
FIG. 3 is an enlarged view of the encircled element 3 shown in FIG. 2.
Figure 4:
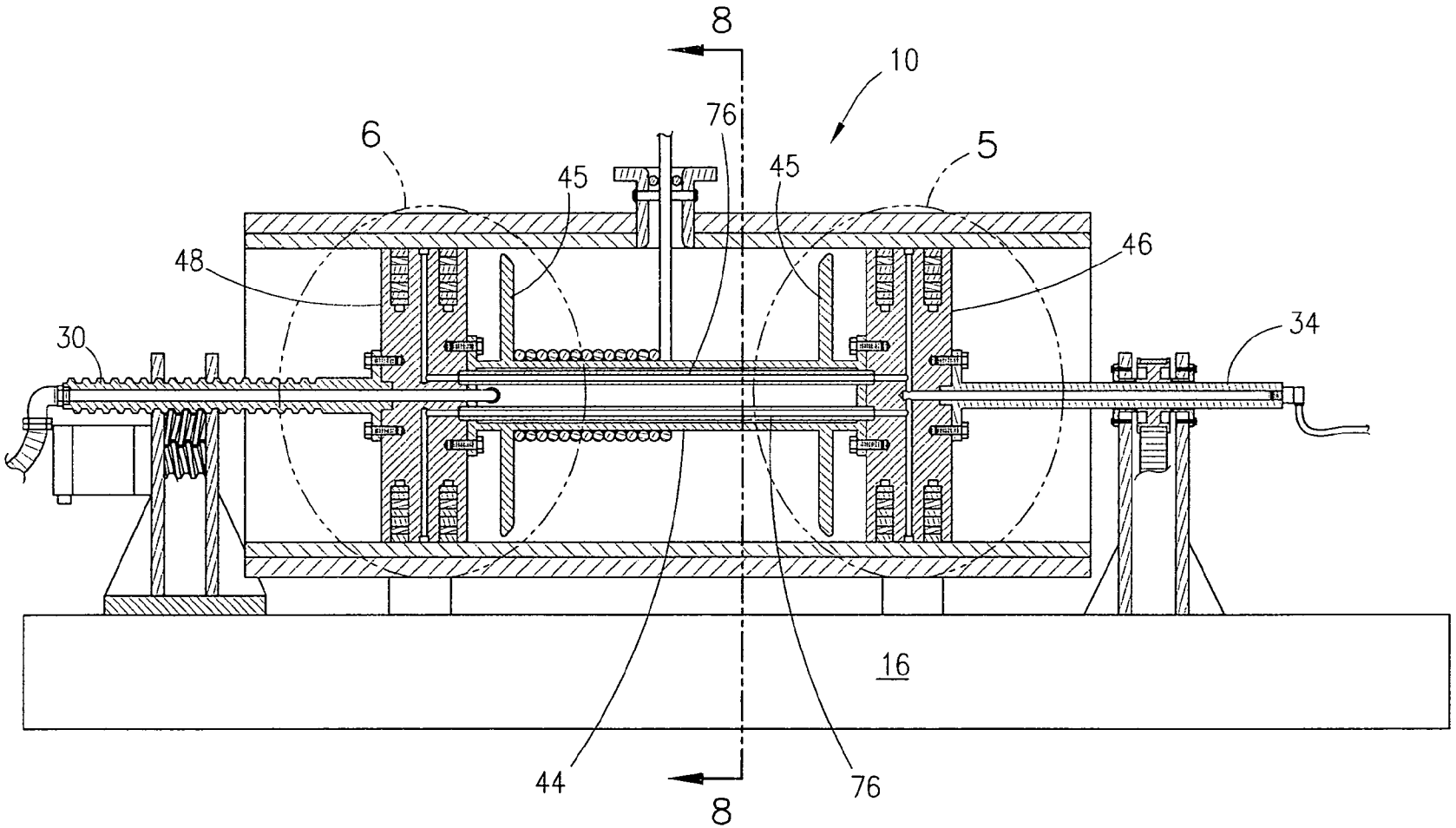
FIG. 4 is a vertical cross section view with the rotating spool members rotated 90 degrees.
Figure 5:
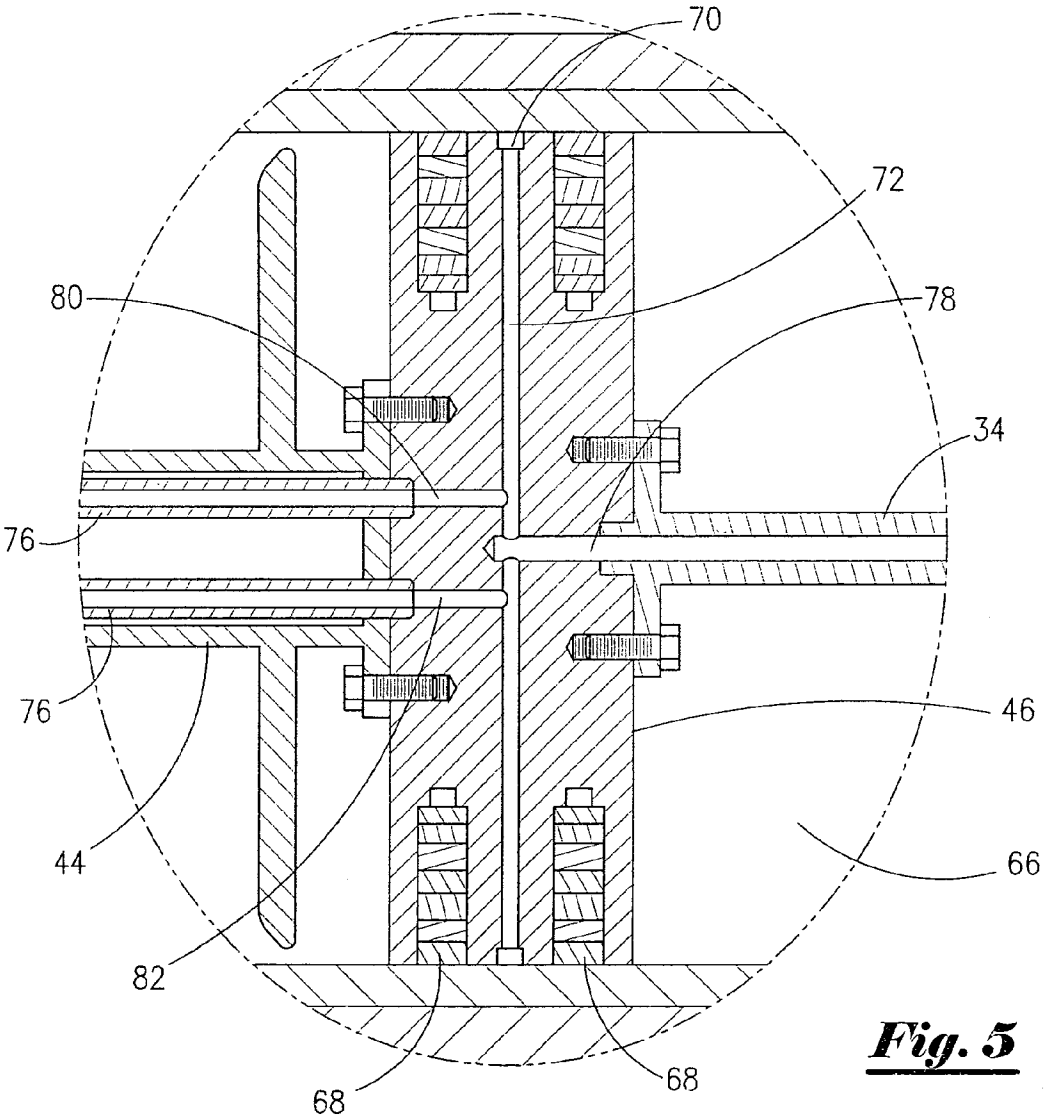
FIG. 5 is an enlarged view of the encircled element 5 shown in FIG. 4.

The spool or reel assembly 18 includes a tubular spindle 44 having retainers or rims 45 with seal members 46, 48 located at each end. The seal member 46, as enlarged for clarity in FIG. 3, is a solid diametrical member only slightly smaller in diameter than the internal diameter of the tubular liner 36 calculated to allow for seal expansion. The spindle 44 is closed at each end and fitted with a flange 50 having holes therein for receiving bolts 52 connecting one end of the spindle 44 to the seal members 46, 48. Seal members 46, 48 each further include diametrical seal ring grooves 54, 56, communicating with narrower pressure grooves 58, 60, which in turn communicate with pressure ports 62, 64 leading to the pressure chamber 66. The plurality of sealing rings 68 includes composite materials as well as individual combinations of hard deformable material, such as brass or silver, and compressible and semi-compressible materials, such as rubber, fibers, polymeric carbon, etc., stacked in layers, so as to provide a very high pressure seal around the periphery of the sealing members when subjected to the pressure within the pressure chamber 66 excreted by the well bore pressure. A lubrication groove 70, located between the grooves 54, 56, is also provided which is in communication with internal lubrication cross ports 72 that communicate with the hollow drive shaft 34 attached to the sealing member with bolts 74. Connection tubes 76 running through the internal bore of the spindle 44 make lubricant communication between the two sealing members 46, 48, as shown in FIG. 4. The lubrication cross porting 72 and connecting passage 78 leading to the hollow drive shaft 34 and passages 80, 82 connecting to the lubrication tubes 76 for the sealing member 46, are best seen in the rotated cross section view shown in FIG. 5.

Figure 6:
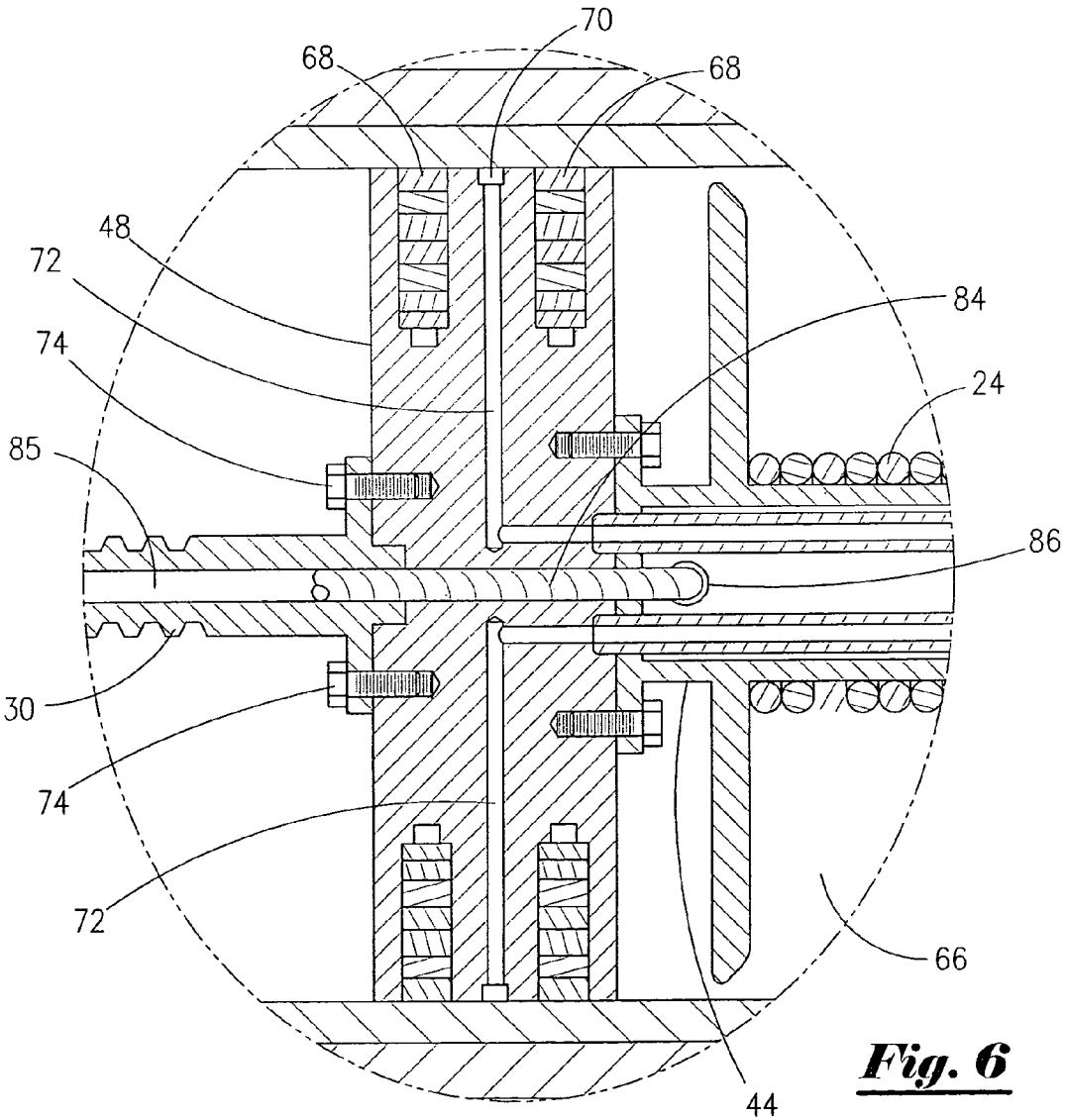
FIG. 6 is an enlarged view of the encircled element 6 shown in FIG. 4.
Figure 8:
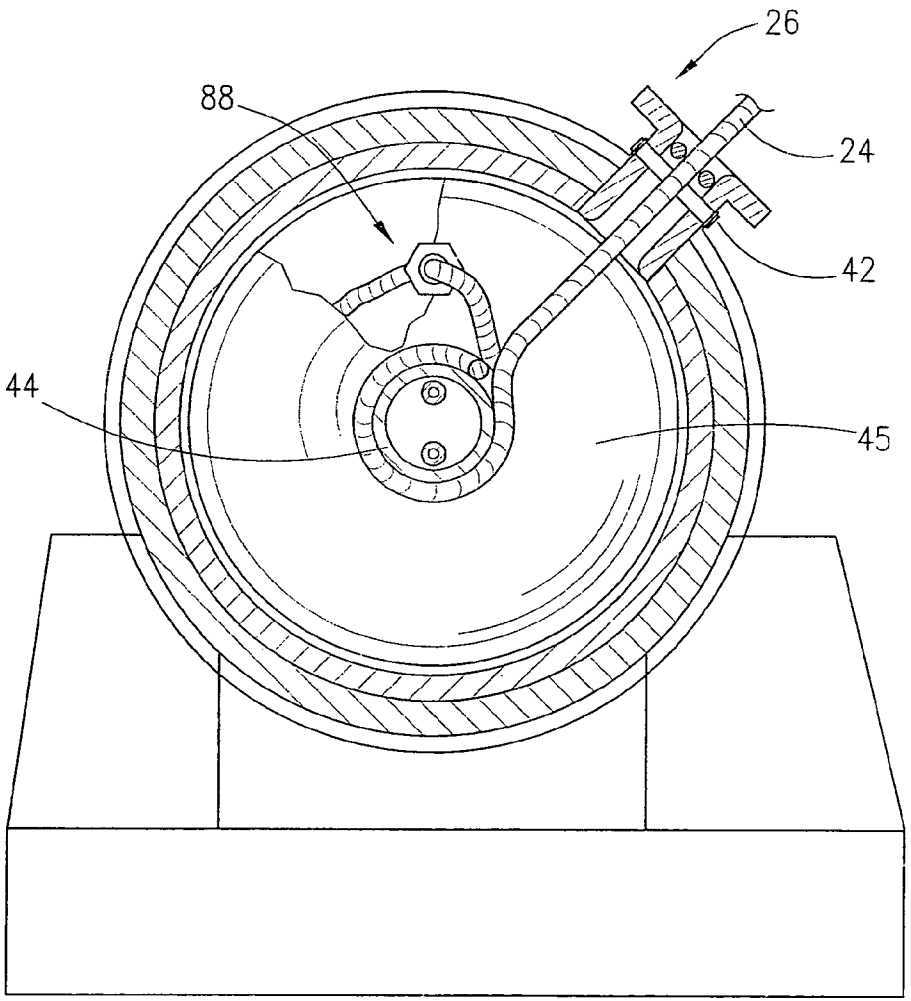
FIG. 8 is a cross section view taken along sight line 8-8 shown in FIG. 4.

Looking now at FIG. 6, we see that sealing member 48 is fitted with an electrical cable 84 extending through the central bore of the drive shaft 30 through a central through bore 85 and enters the pressure chamber 66 through a sealable electrical cable port 86 located within the spindle 44 where the cable 84 terminates in an explosion-proof electrical connector 88, as seen in FIG. 8.

Figure 7:
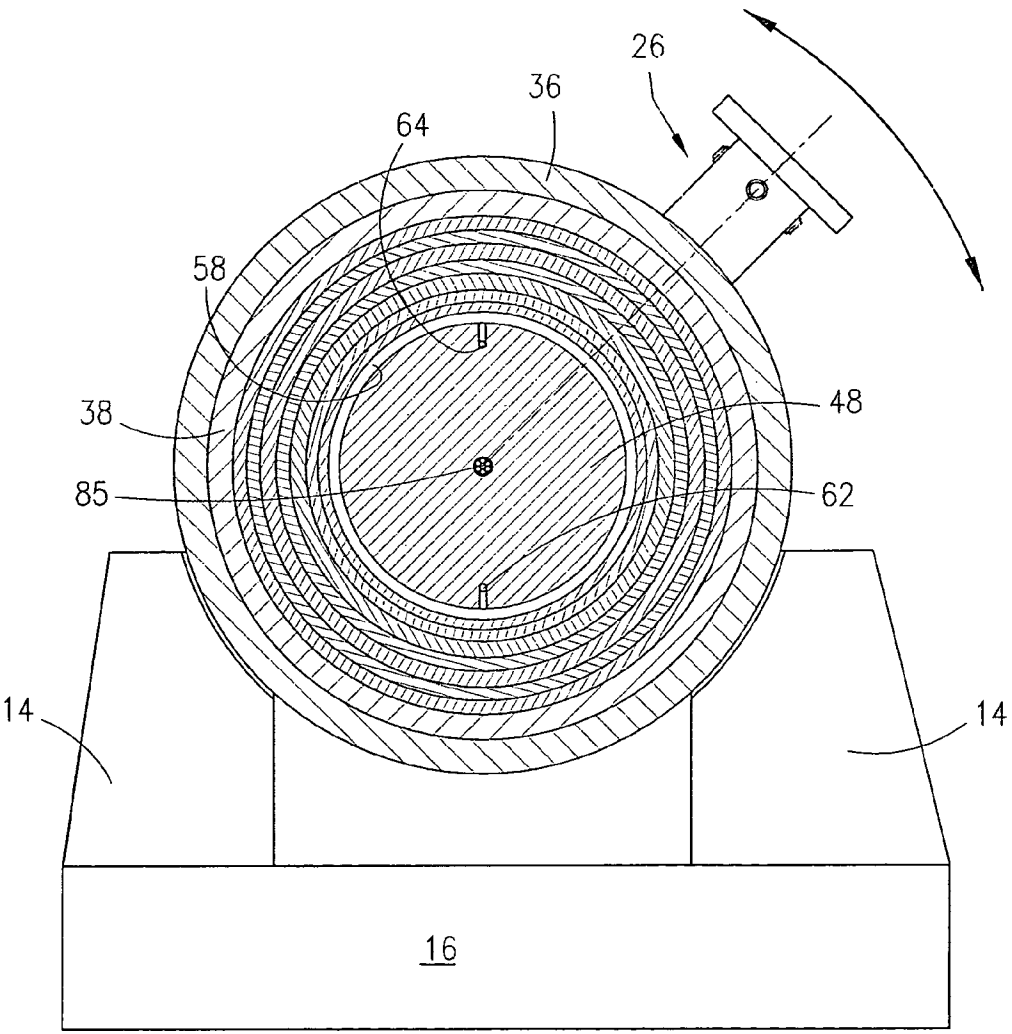
FIG. 7 is a cross section view taken along sight line 7-7 shown in FIG. 2.

As shown in FIG. 7, the elongated casing 36 is rotatable relative to the support saddles 14. It should be noted that each of the rings 68 is mitered at each end and staggered relative to each other in order to help prevent pressure leakage.

A seen in FIG. 8, we see the wire line cable 24 paying out through the pressure flange assembly 26 guided therein by internal guide rollers 42

Figure 9:
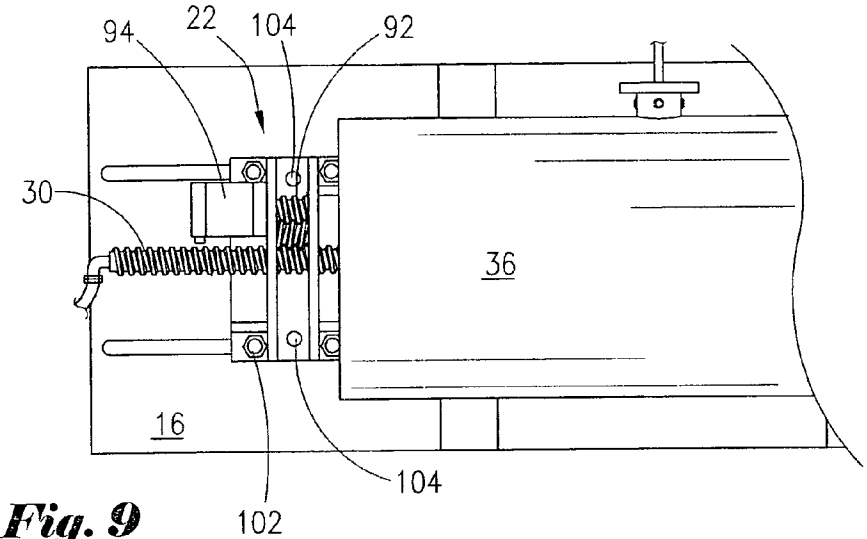
FIG. 9 is a partial top view of the wire-line reel assembly shown in FIG. 1 with translating drive assembly in a first position.
Figure 10:
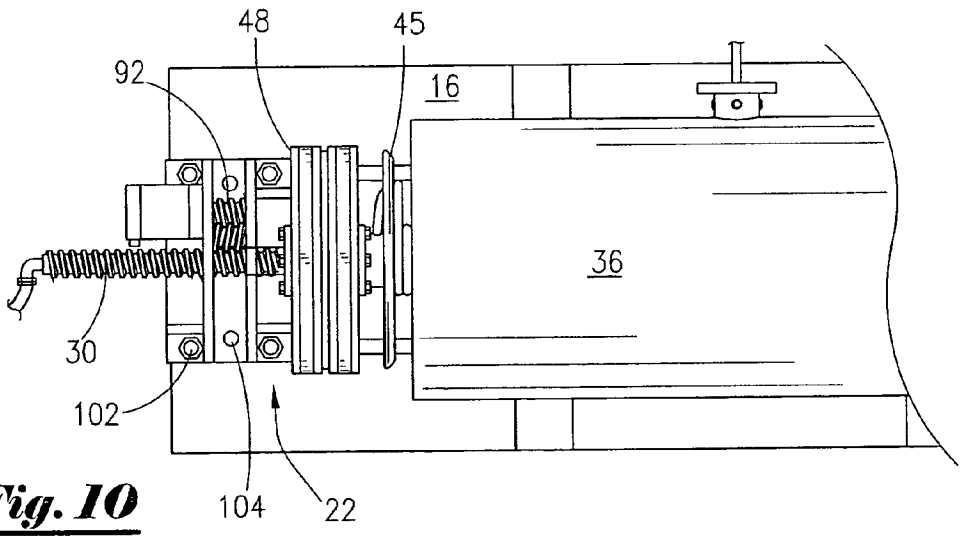
FIG. 10 is a partial top view of the wire-line reel assembly shown in FIG. 1 with translating drive assembly in a second position and at least one cylinder member exposed.

Returning now to FIG. 1, we see that the translation drive assembly 22 includes the externally threaded hollow drive shaft 30 rotatably supported as it passes through the support frame 90. The support frame 90 is also translatably adjustable along the longitudinal axis of the support frame 16. The support frame also contains the drive and intermediate worm gears 92 cooperative with the threads located on translating shaft 30 and programmable drive motor 94 as also further seen in FIG. 9, shown in position 1 and held in place by hold-down bolts 102 and pull-pins 104. As the reel assembly 18 rotates within the housing assembly 12, the drive assembly 22 is programmed in a synchronized manner with the rotary drive assembly 20 to maintain a translating to and fro lead regardless of rotary speed or cable diameter, thus insuring a smooth winding of the cable 24 upon the spindle 44. Since the support frame 90 is longitudinally translatable relative to frame 16, pull pins 104 may be displaced so as to allow the support frame 90 to move longitudinally when the drive is motor 94 is activated. Repinning the support frame 90 in a second position near the outer end of the drive shaft 30 allows the drive motor 94 to retract the spool assembly 18 relative to the housing assembly 12, thus exposing the spool assembly 18 for inspection or removal as seen in FIG. 10. This is also a means for making or breaking the electrical connection when changing cables.

The rotary drive assembly 20 located at the opposite end of the spool assembly 18 and attached to the base structure 16 includes a mounting frame assembly 96, a hydraulic drive motor 98 with a drive sprocket, a drive belt, and driven sprocket rotatably supported within the frame assembly 96. The drive shaft 34 is slidable or translatable through a driven sprocket assembly 100.

Figure 11:
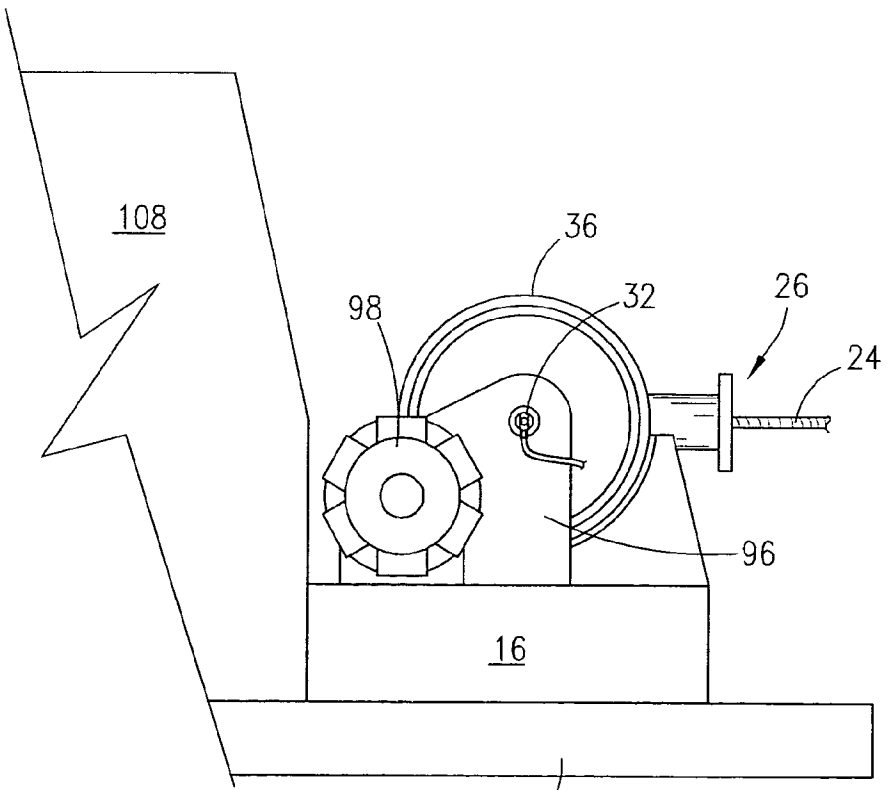
FIG. 11 is a right side view of the wire-line reel assembly shown in FIG. 1.

As shown in FIG. 11, the pressurized wire line cable assembly 10 may be mounted on a skid 106 having a cabin 108. A shield or hood 110 may also be added to fully enclose the moving parts of the assembly 10 if desired, as illustrated in FIG. 12.

Figure 14:
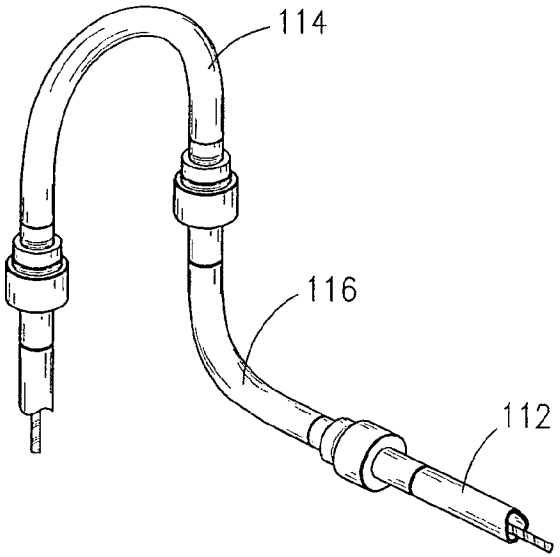
Fig. 14 PRIOR ART
FIG. 14 is an isometric view of the enclosed articulated radial cable conveyors.
Figure 12:
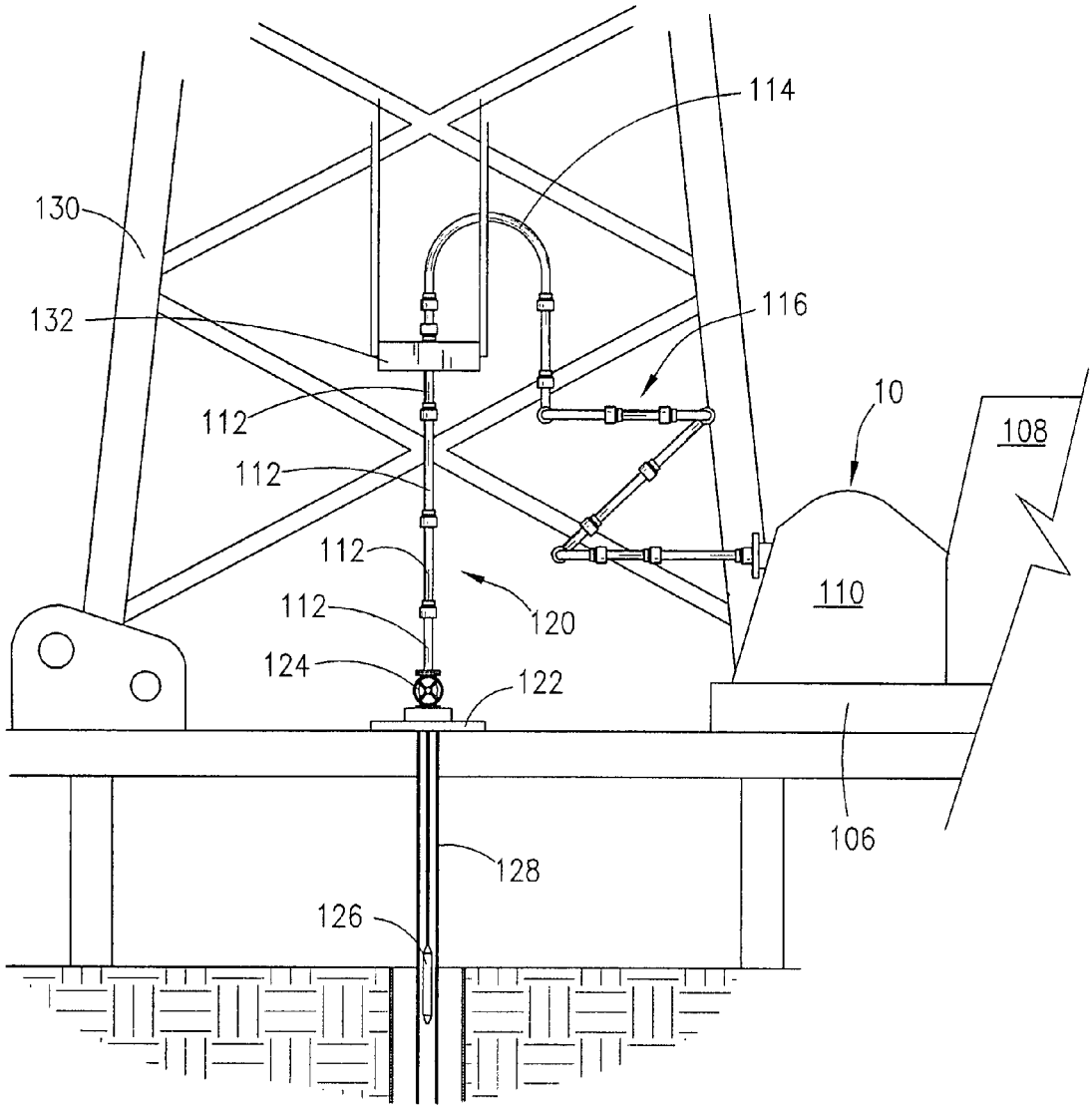
FIG. 12 is a vertical elevation view of the wire-line reel assembly connected to a wellhead wire line riser assembly with a plurality of the enclosed articulated radial cable conveyor assemblies retracted.
Figure 15:
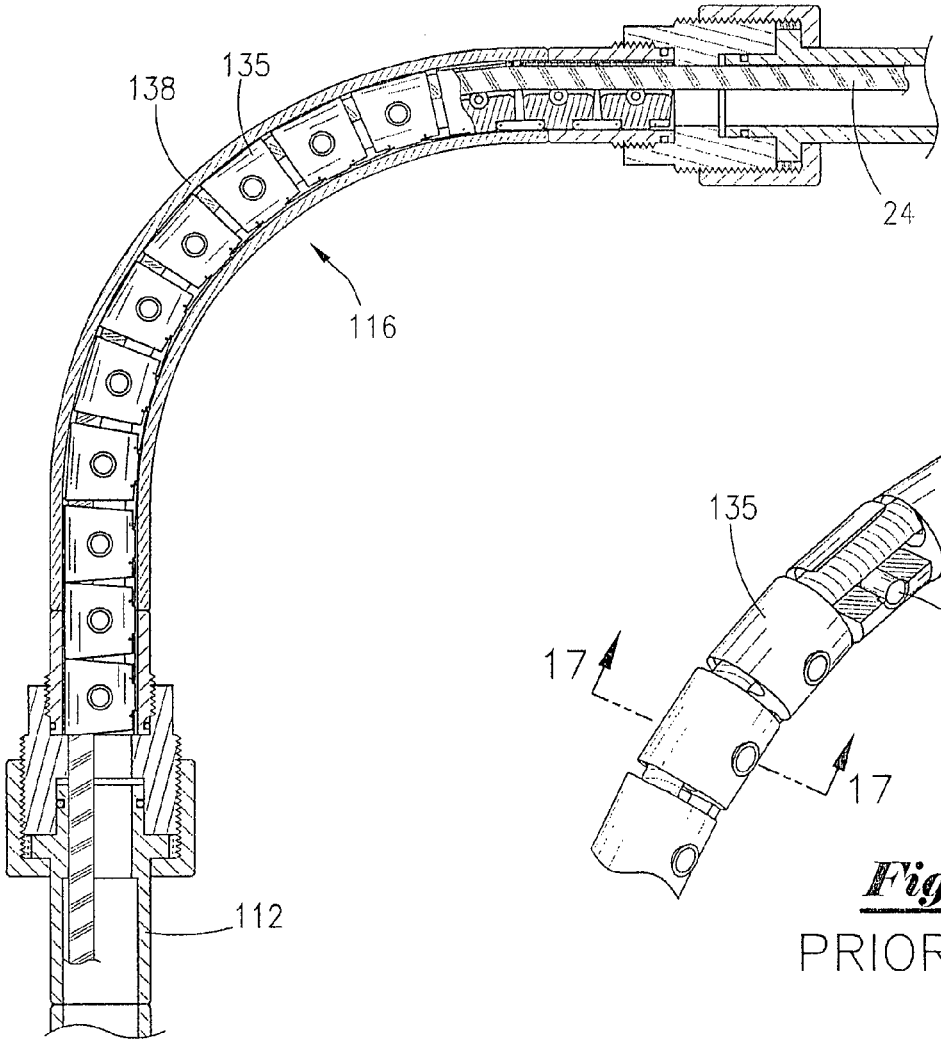
Fig. 15 PRIOR ART
FIG. 15 is cross-section view of the enclosed articulated radial cable conveyors.

FIG. 12 further shows how the pressurized cable or wire line winch assembly 10 is able to reduce set up time using a plurality of radial enclosed wire line cable conveyor assemblies. The process of setting up the wire line riser assembly still requires a plurality of vertical tubular joints 112 with sufficient length to accommodate the down-hole tools to be inserted. However, in this case, additional vertical length to accommodate additional sinker bars is not necessary, thus reducing the riser string height. A prior art 180 degree radial enclosed wire line cable conveyor 114 and a plurality of 90 degree radial enclosed wire line cable conveyors 116, seen in FIG. 14, are attached to the vertical riser string in an articulated manner using fast couplings common within the art forming an extendable configuration as shown in FIG. 12. One end of the wire line cable 24 extending from the wire line cable winch assembly 10 is then threaded through the cable conveyors 114, 116, as shown in FIG. 15, and tubular joints 112 forming the riser assembly 120 and connected to the tool to be inserted within the well head 122 under pressure. The tool is then withdrawn into the vertical tubular joints 112 of the riser assembly 120 by retracting the wire line cable with the winch assembly 10. One end of the riser assembly 120 is then attached to the wire line winch assembly 10 and the tubular joint 112 portion of the riser assembly 120 is attached to the wellhead 122. When the wellhead valve 124 is opened, pressure upon the spool assembly 18 of the wire line cable winch assembly 10 becomes equal to the well bore pressure and maintained therein. Since the pressure in the riser assembly is now equalized, the down-hole tool 126 being inducted into the well bore 128 only needs to overcome frictional resistance. Therefore, less weight is needed.

Figure 13:
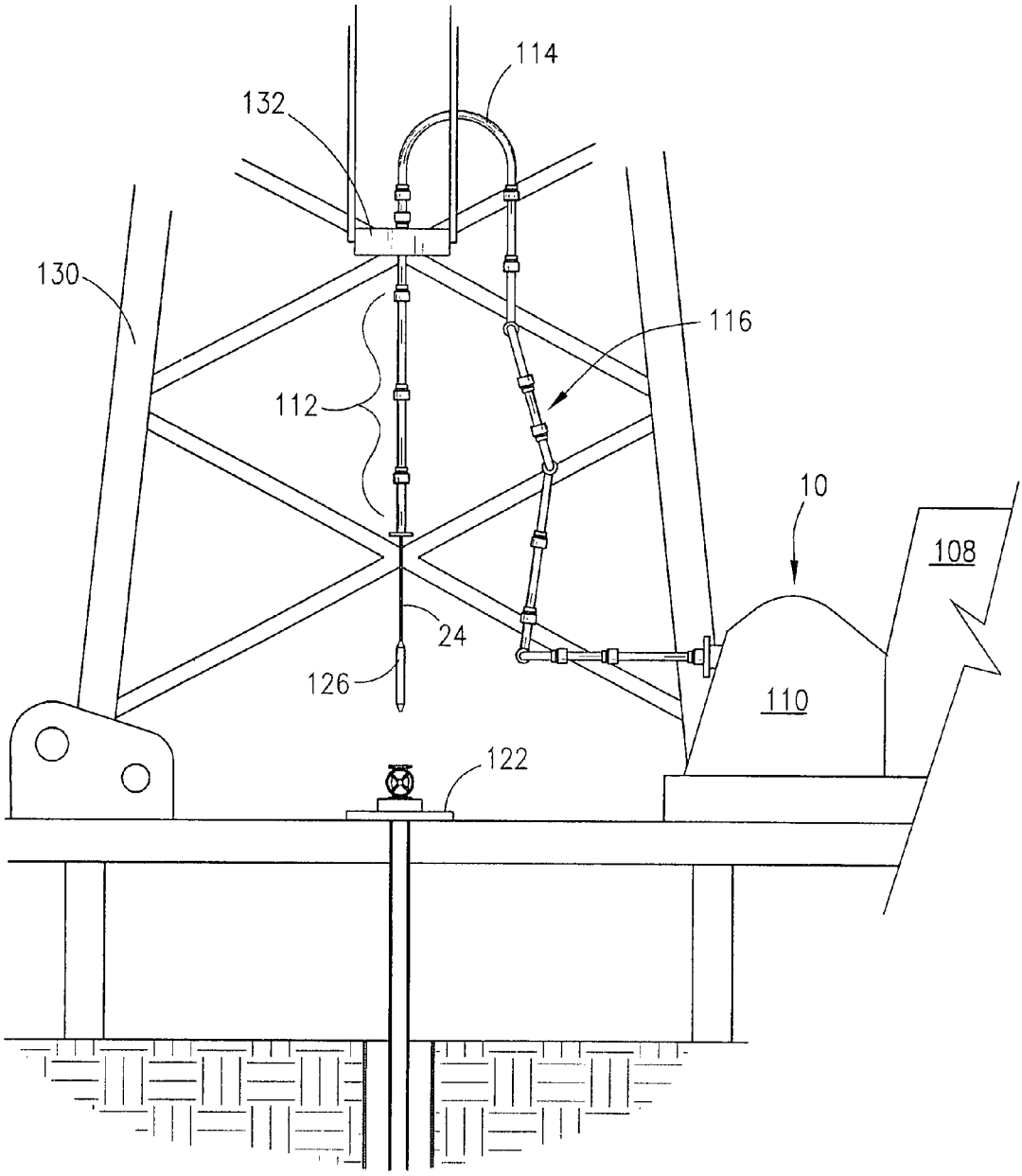
FIG. 13 is a vertical elevation view of the wire line reel assembly connect to a well head wire line riser assembly with a plurality of the enclosed articulated radial cable conveyor assemblies elevated as necessary to accommodate varying length tools and instruments.

Removing down-hole tools from the tubular joints 112 is done by with-drawing the tool 126 to a point within the vertical riser joints, closing the valve 124 and venting the riser assembly 120. The riser assembly 120 may then be disconnected from the wellhead 122 and raised using the derrick 130 elevator 132 a sufficient height to remove the tool 126 by allowing the conveyor assemblies 116 to articulate and be coupled in a switch-back manner thereby not disturbing the wire line winch assembly 10, as shown in FIG. 13.

Figure 16:
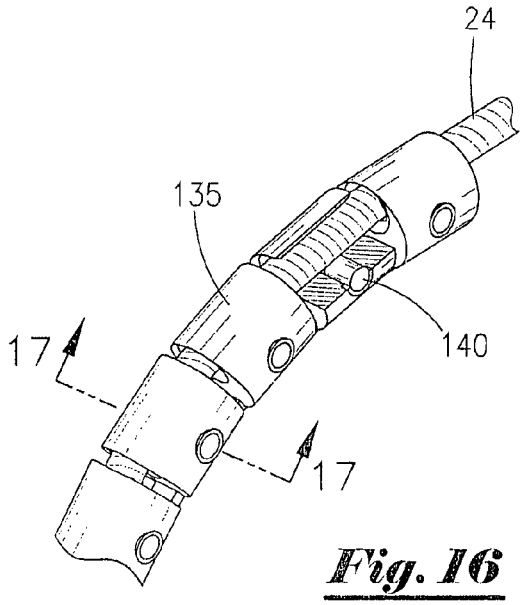
Fig. 16 PRIOR ART
FIG. 16 is an isometric cur-away view of the cable passing through the conveyors seen in FIG. 15.
Figure 17:
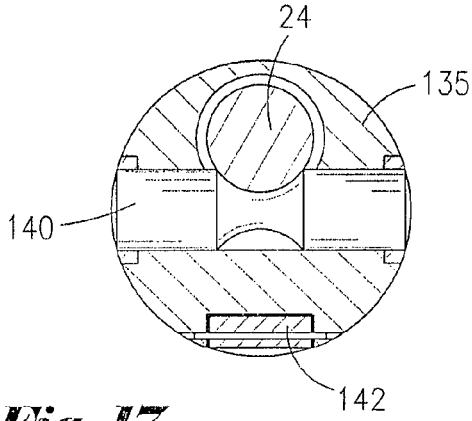
Fig. 17 PRIOR ART
FIG. 17 is a cross-section view of the conveyor shown in FIG. 16.

The prior art enclosed articulatable cable conveyor assembly 114 more clearly defined in FIG. 15, wherein the conveying segments 135 are mitered to allow for entrainment along a radial path within an enclosed tubular member 138 that may form any number of degrees but preferably 90 and 180 degrees. The cable 24 is threaded through each segment 135 and supported and conveyed therein by rollers 140, as shown in FIG. 16 and further in cross section in FIG. 17. Connectors 142 as seen in FIG. 17 connect the segments 135 to each other.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A wire line winch assembly comprising:

a) a base;

b) an elongated tube open at each end supported by said base;

c) a spool assembly having a cylinder attached to each end, each cylinder having external grooves and pressure expandable sealing rings, said spool assembly translatable and rotatable within said tube;

d) a means for rotating said spool assembly;

e) a means for translating said spool assembly while rotating; and f) a wire line cable wound upon said spool.

2. The wire line winch assembly according to claim 1 wherein said tube further comprises a perpendicular opening located intermediate said open ends and a pressure flange and neck assembly extending outwardly from said opening.

3. The wire line winch assembly according to claim 2 wherein one end of said wire line cable extends outwards through said pressure flange and neck assembly.

4. The wire line winch assembly according to claim 2 wherein said pressure flange further comprises a plurality of rollers.

5. The wire line winch assembly according to claim 1 wherein said tube further comprises an internal honed and polished liner.

6. The wire line winch assembly according to claim 1 wherein each said cylinder is internally ported to communicate with a well bore pressure source, an electrical supply source, and a lubrication supply source.

7. The wire line winch assembly according to claim 6 wherein said sealing rings are expanded by said well bore pressure.

8. The wire line winch assembly according to claim 6 wherein said spool assembly further comprises a rotating electrical connection assembly isolated from said well bore pressure having means for connecting to an electrical supply source.

9. The wire line winch assembly according to claim 8 wherein said wire line cable is an electrical conductor cable having means for connecting to said rotating electrical connection assembly.

10. The wire line winch assembly according to claim 1 wherein said sealing rings are formed of a plurality of layers comprised of compressible and semi-compressible materials mitered at each end to allow for pressure expansion.

11. A wire line cable winch assembly capable of sustained pressurized communication with the interior of a well bore under pressure the assembly comprising:

a) a base frame structure;

b) an elongated tubular assembly supported by said base frame structure having open ends, a longitudinal internal bore and a perpendicular opening located intermediate the open ends fitted with a pressure flange and neck assembly for connection to a well bore under pressure;

c) a spool assembly translatable and rotatable within said tubular assembly further comprising;

i) a cylinder attached to each end of said spool;

ii) a plurality of stacked pressure expandable sealing rings, located within at least two ring grooves, encircling each said cylinder in rotating and sliding contact with said internal bore;

iii) a plurality of pressure ports within each said cylinder communicating with said spool and said rings; and iv) at least one peripheral lubrication groove intermediate said ring grooves in each cylinder having internal ports communicating with a lubrication supply source;

d) a means connected to one said cylinder for rotating said spool assembly within said tubular assembly;

e) a means connected to one said cylinder member for translating said spool assembly longitudinally within said tubular assembly; and f) a wire line cable having length wound in successive layers upon said spool one end of which extending through said pressure flange and neck assembly for induction into a well bore under pressure.

12. The wire line cable winch assembly according to claim 11 wherein said tubular assembly further comprises a honed and polished hard chrome internal liner.

13. The wire line cable winch assembly according to claim 11 wherein said tubular assembly is rotatable relative to said base frame structure.

14. The wire line cable winch assembly according to claim 11 wherein said spool assembly further comprises a tubular spindle sealed at each end having an external rim adjacent each end and at least one internal tube extending the length of said spindle, in communication with said internal ports in each said cylinder communicating with said lubrication supply source.

15. The wire line cable winch assembly according to claim 14 wherein said spindle further comprises a sealable electrical cable port penetrating one wall adjacent one end of said spindle and a centralized port extending through one end of said spindle said centralized port in communication with a central bore extending through one said cylinder.

16. The wire line cable winch assembly according to claim 11 wherein said means for rotating said spool assembly comprises:

a) a keyed elongated shaft member having a central bore attached to one said cylindrical member opposite said spool assembly having internal porting, for communicating with a lubrication supply source, communicative with said central bore; and b) a rotary drive assembly rotatably connected to said keyed shaft in a manner whereby said keyed shaft is longitudinally translatable relative to said drive assembly.

17. The wire line cable winch assembly according to claim 16 wherein said means for translating said spool assembly comprises:

a) an elongated translating shaft having external threads along the majority of its length and a central bore, attached to said cylinder located opposite said spool and said means for rotating, said central bore in communication with a central bore in said cylinder;

b) an electrical slip ring assembly attached to one end of said translating shaft and an electrical cable extending from said slip ring assembly through said translating shaft, said cylinder member attached thereto, said electrical cable port within said spindle terminating in an explosion-proof electrical connector located adjacent one said external rim;

c) a translating drive assembly rotatable connected to said externally threaded elongated shaft in a manner whereby said translating drive positions said spool assembly longitudinally relative to said tubular assembly while said spool is being rotated.

18. The wire line cable winch assembly according to claim 17 wherein said rotary drive assembly further comprises a driven sprocket slidable along said keyed shaft rotatably retained within a mounting frame attached to said base frame structure, a drive motor attached to said mounting frame having a drive sprocket attached thereto, and a flexible means for connecting said drive and driven sprockets.

19. The wire line cable winch assembly according to claim 18 wherein said translating drive assembly further comprises a base plate and a pair of vertical frame members, an intermediate driven worm gear in rolling interfacing contact with said externally threaded elongated shaft rotatable supported by said vertical frame members, and a programmable drive motor attached to one of said vertical frame members having a drive worm gear attached thereto in rolling interfacing contact with said intermediate worm gear.

20. The wire line cable winch assembly according to claim 19 wherein said translating drive assembly is longitudinally positional relative to said base frame structure.

21. The wire line cable winch assembly according to claim 20 wherein said programmable motor is synchronized with the rotation speed of said spool assembly and diametrical size of said wire line cable.

22. The wire line cable winch assembly according to claim 19 wherein said translating drive assembly is positioned in a manner whereby actuating said drive motor extracts at least a portion of said spool assembly from within said elongated tubular assembly.

23. The wire line cable winch assembly according to claim 11 wherein said pressure expandable rings comprise a plurality of compressible and semi-compressible ring members interspersed within each ring groove.

24. A wire line cable winch assembly capable of sustained pressurized communication with the interior of a well bore under pressure the assembly comprising:

a) a base frame structure;

b) an elongated tubular assembly supported by said base frame structure having open ends, a longitudinal internal bore and a perpendicular opening located intermediate the open ends fitted with a pressure flange and neck assembly for connection to a well bore under pressure;

c) a spool assembly translatable and rotatable within said tubular assembly further comprising;

i) a cylinder attached to each end of said spool;

ii) a plurality of stacked pressure expandable sealing rings, located within at least two ring grooves, encircling each said cylinder in rotating and sliding contact with said internal bore;

iii) a plurality of pressure ports within each said cylinder communicating with said spool and said rings; and iv) at lease one peripheral lubrication groove intermediate said ring grooves in each cylinder having internal ports communicating with a lubrication supply source;

d) a means connected to a first said cylinder opposite said spool assembly for rotating said spool assembly within said tubular assembly;

e) a means connected to a second said cylinder opposite said spool for translating said spool assembly longitudinally within said tubular assembly;

f) a wire line cable having length wound in successive layers upon said spool one end of which extending through said pressure flange and neck assembly for induction into a well bore under pressure; and g) a well head wire line riser assembly having a plurality of articulated enclosed radial cable conveyors connected to said pressure flange and neck assembly.

25. A method for coupling a wire line cable winch assembly to a well head under well bore pressure said cable spool capable of sustaining said well bore pressure the method comprising the steps of:

a) assembling a wire line riser having a plurality of articulated enclosed wire line conveyers each having a plurality of mitered cylindrical roller cable carrier segments therein;

b) attaching one end of said riser to a well head under pressure and attaching the opposite end to a remote wire line cable spool assembly; comprising an open ended tubular member having a rotatable and translatable spool assembly therein and a pressure flange connection c) threading one end of a cable wound upon said cable spool through said pressure flange connection and said wire line riser for attachment to a down-hole tool;

d) attaching said down-hole tool to said cable and withdrawing said tool into said riser assembly by rotating said cable spool; and e) attaching said riser to said well head, thus providing pressure communication between said well head and said cable spool and releasing said well bore pressure into said riser thereby allowing said tool to be lowered into said well bore under pressure.

* * * * *